United States Patent [19]

Aida et al.

[11] Patent Number: 4,726,308

[45] Date of Patent: Feb. 23, 1988

[54] THREAD TENSION CONTROL DEVICE FOR OVEREDGE SEWING MACHINES

[75] Inventors: Kikuo Aida; Shingo Iwae, both of Chofu, Japan

[73] Assignee: Tokyo Juki Industrial Co., Ltd., Tokyo, Japan

[21] Appl. No.: 920,702

[22] Filed: Oct. 17, 1986

[30] Foreign Application Priority Data

Oct. 18, 1985 [JP] Japan ..... 60-233945

[51] Int. Cl.[4] ..... D05B 47/04

[52] U.S. Cl. ..... 112/254; 112/165; 112/166

[58] Field of Search ..... 112/254, 165, 166; 242/150 R

[56] References Cited

U.S. PATENT DOCUMENTS 1,748,052 2/1930 Becker ..... 112/166
3,356,050 12/1967 Urscheler ..... 242/150 R
3,908,929 9/1975 Stritzko ..... 242/150 R
4,300,464 11/1981 Bonalumi ..... 112/166
4,611,547 9/1986 Kuramoto ..... 112/254

FOREIGN PATENT DOCUMENTS 2362481 6/1975 Fed. Rep. of Germany ... 242/150 R

*Primary Examiner*—Andrew M. Falik
*Attorney, Agent, or Firm*—Morgan & Finnegan

[57] ABSTRACT

A thread tension control device for overedging sewing machines wherein each needle thread tension controller and each looper thread tension controller provide two springs designed to clamp two tension discs wherethrough a thread is passed. A slide plate, by its horizontal sliding motion, either causes the two springs to be active or causes one of the two springs to be released thereby obtaining either strong or weak thread tension. A workpiece end detector defines either an overedging process or thread chain forming process and sends a signal to actuate the horizontal sliding motion of the slide plate. Thus, the proper thread tensioning for each needle thread and each looper thread for either an overedging process or a thread chain forming process may be automatically adjusted.

3 Claims, 9 Drawing Figures

THREAD TENSION CONTROL DEVICE FOR OVEREDGE SEWING MACHINES

BACKGROUND OF THE INVENTION

This invention relates to thread tension control devices for overedging sewing machines. More particularly, this invention relates to thread tension control devices wherein the needle threads are controlled to be at a relatively high tension and the looper threads to be at a relatively low tension during an overedging process and the needle threads are controlled to be at a relatively low tension and the looper threads to be at a relatively high tension during a process of forming thread chains which extend from the fabric material after its sewing, and wherein thread tension conditioning for each process can be regulated.

In the prior art is Japanese utility model publication 57-59105. According to this publication, two thread tension controllers are provided for both the needle thread passageway and the looper thread passageway (for two needle overedge sewing machines). Additionally, two more auxiliary thread tension controllers are provided for both the needle thread passageway and the looper thread passageway and these auxiliary tension controllers are actuated by a solenoid energized by signals from sensors which detect the leading edge and the trailing edge of the fabric material. Thus, proper thread tension for the overedging process and the thread chain forming process are regulated.

The aforementioned conventional overedging sewing machine provides two thread tension controllers for both the needle thread passageway and the looper thread passageway and two additional auxiliary thread tension controllers for both passageways. Thus, the mechanism is complicated and the controllers occupy substantial space and as a result the machine design is neglected.

SUMMARY OF THE INVENTION

With the foregoing in mind, it is an object of the invention to provide a new and improved thread tension control device for an overedging sewing machine that provides for proper thread tensioning during the overedging and thread chain forming processes.

In a preferred embodiment according to the invention, two springs are provided at a control shaft of a thread tension controller and the two springs press tension discs which clamp the thread. The up and down motion of a tension post, caused by the movement of the controller, actuates the force of either the two springs simultaneously or only one of them. Thereby, this invention eliminates the aforementioned demerits of conventional overedging sewing machines.

As described above, a thread tension controller is provided at each passageway for the needle thread and the looper thread. Two springs are positioned in the axial direction of the thread controller and press the tension discs which clamp the thread. The slide plate either causes simultaneous actuation of the two springs or causes one of the springs to release. Thus, the proper tension for each needle thread and looper thread is adjusted for ordinary overedging process or for thread chain forming process, respectively. In comparison with the conventional type of thread tension controller previously described, this invention reduces the number of tension controllers (from 8 to 4) and correspondingly the space occupied by the tension controllers is reduced. The construction itself is very compactly designed and, in addition, the thread tension controllers are positioned in one location such that operators can easily adjust the thread tension controllers. As a result, work efficiency is enhanced.

BRIEF DESCRIPTION OF THE DRAWINGS

The accompanying drawings, referred to herein and constituting a part hereof, illustrate a preferred embodiment of the invention and, together with the description, serve to explain the principles of the invention, wherein.

DETAILED DESCRIPTION OF THE DRAWINGS

Figure 1:
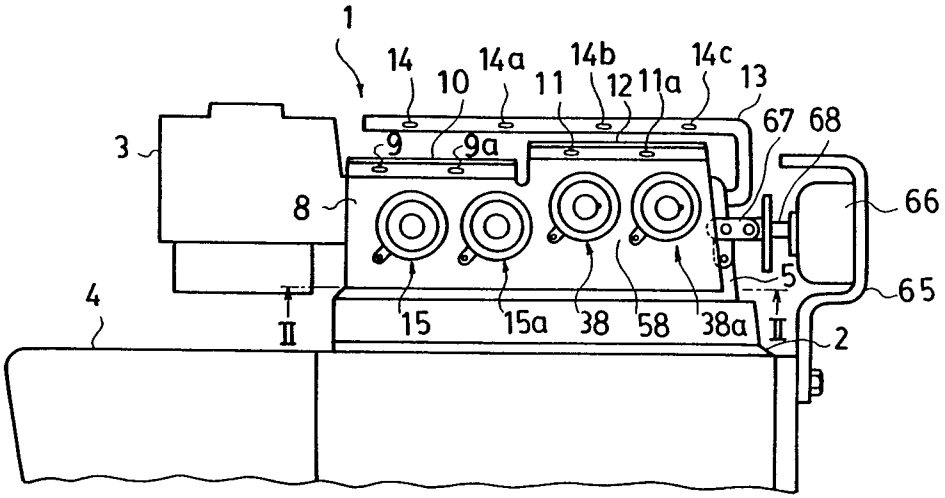
FIG. 1 is a partial front view of an overedging sewing machine according to the invention.

Referring to the accompanied drawings, one embodiment of the present invention as applied to a two-needle, two-looper overedging sewing machine will be explained. FIG. 1 is a partial front view of an overedging sewing machine. A machine 1 basically comprises a body 2, an arm 3, and a table 4. Numeral 5 denotes a cover installed on the upper plane of the body 2. A thread guide plate 8 is fixed to the cover 5 by a spacer screw **6*b*, with spacer 6 located in between, keeping a predetermined clearance 7**.

A needle thread guide 10 with its thread holes 9, **9*a* and a looper thread guide 12 with its thread holes 11, 11*a* are provided on the upper side of guide plate 8. Numeral 13 denotes a thread guide and its base portion is fixed to the body 2. The free end of thread guide 13 is arranged in parallel with the body 2 and, on the parallel portion, thread holes 14, 14*a*, 14*b*, 14*c* are provided. Numerals 15, 15*a* denote needle thread tension controllers which are positioned in parallel. Since the needle thread tension controllers 15, 15*a* are similarly constructed, only needle thread tension controller 15 will be explained in referring to the accompanied drawings FIGS. 3 and 6**.

Figure 6:
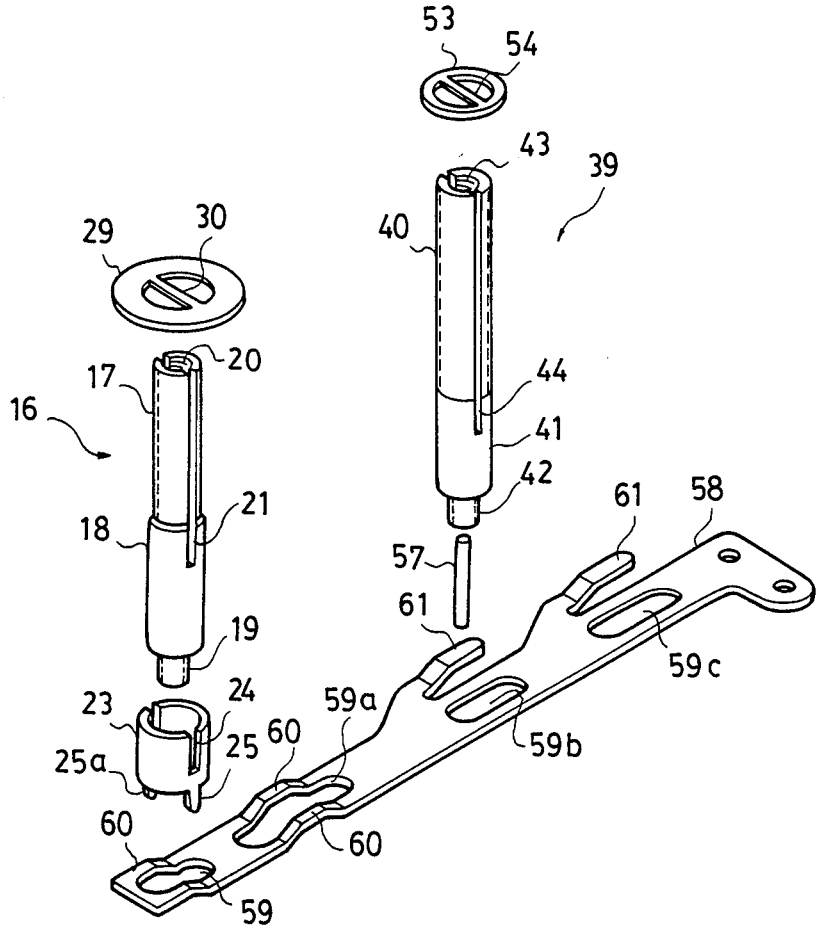
FIG. 6 is a perspective view of a slide plate and a partial perspective view of a needle thread tension controller and a looper thread tension controller according to the invention.

Numeral 16 denotes a tension shaft. The tension shaft 16 comprises an upper screw 17, a shaft portion 18, and a lower screw portion 19 (see FIG. 6). Referring to FIG. 6, a screw hole 20 is provided at the upper screw 17 and a slit 21 is formed at the shaft portion 18 along the shaft. The tension shaft 16 is fixed to cover 5 with a nut 22 and screw 19. Numeral 23 denotes a sleeve and is slidably sustained over the shaft portion 18 of the tension shaft. A slit 24 is provided in the direction of the shaft axis at the upper portion of the sleeve 23. A pair of projections 25, 25*a* are provided at the bottom of the sleeve 23.

Figure 3:
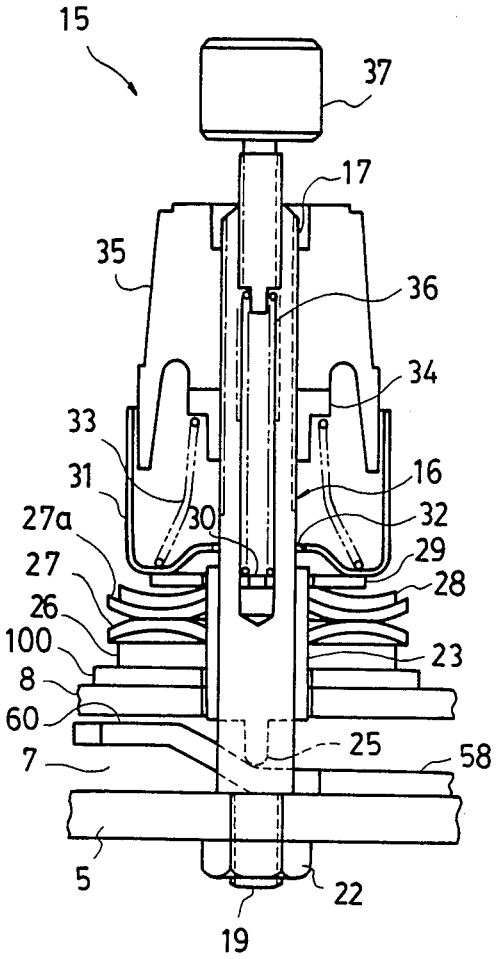
FIG. 3 is a partial longitudinal section view of a needle thread tension controller.

Referring to FIG. 3, around the outer circumference of the sleeve 23, from bottom to top, are slidably sustained a needle thread guide 100, a felt ring 26, a pair of tension discs 27, 27*a*, and a felt ring 28. Numeral 29 is a ring-shaped presser plate and provides a bridge 30 (see FIG. 6). The presser plate 29 is slidably sustained on the shaft portion 18 of the needle tension shaft 16 with its bridge 30 slidably inserted in the slit 21 of tension shaft 16 and slit 24 of sleeve 23.

Referring to FIG. 3, numeral 31 denotes a cup-shaped presser with shaft portion 18 of tension shaft 16 slidably inserted in its central hole 32 and its bottom portion contacting the upper face of the presser plate 29. Numeral 33 denotes a first spring installed inside of the cup-shaped presser which controls the needle thread tension. Numeral 34 is a bushing-like spring seat for the spring 33 and is slidably sustained on the screw portion of tension shaft 16.

The first spring 33 is inserted in between the lower surface of the spring seat 34 and the inner bottom surface of the cup-shaped presser 31. Numeral 35 is a tension knob with its center portion screwed onto the screw 17 of tension shaft 16 and its bottom face contacting the upper surface of spring seat 34. Accordingly, rotation of the tension knob causes the first spring 33 to expand or contract and thereby the clamping force between the tension discs 27, 27*a* is adjusted.

Numeral 36 denotes a second spring for needle thread tension control. The second spring 36 is inserted into the screw hole 20 of the tension shaft 16 and its bottom end contacts bridge 30 of the presser plate 29. Numeral 37 is a tension knob and is screwed into the screw hole 20 of the tension shaft 16. Rotating the tension knob causes variation of the clamping force between the tension discs 27, 27*a* as the presser plate 29 moves up or down.

Numerals 38, 38*a* are looper thread tension controllers and are located in parallel. Since the looper thread controllers 38, 38*a* are similarly constructed, only looper thread controller 38 will be explained in reference to FIGS. 4 and 6.

Referring to FIG. 6, numeral 39 denotes a tension shaft and comprises an upper screw portion 40, a shaft portion 41, and a lower screw portion 42. A screw hole 43 is provided at the upper portion of the tension shaft 39 and a slit 44 is formed along the tension shaft 39. The tension shaft 39 is screwed into the thread guide plate 8 by the screw portion 42 inserting a looper thread guide 101 in between.

Around the tension shaft 39, from bottom to top, are slidably sustained a felt disc 45, a pair of tension discs 46, 46*a*, and a felt disc 47. Numeral 48 denotes a cup-shaped presser with the shaft portion 41 of the tension shaft 39 inserted in its central hole 49. Numeral 50 is a first spring installed inside of the cup-shaped presser 48 which controls the looper thread tension. Numeral 51 denotes a bushing-like spring seat and is slidably sustained on the screw portion 40 of tension shaft 39. The first spring 50 is placed in between the spring seat 51 and the inner bottom surface of the cup-shaped presser 48.

Numeral 52 denotes a tension knob and its central portion is screwed onto screw portion 40. Rotation of tension knob 52 causes the first spring 50 to expand or contract as the spring seat 51 moves up and down thereby adjusting the clamping force between the tension discs 46, 46*a*. Numeral 53 denotes a ring-shaped presser plate and forms a bridge 54 (see FIG. 6). The bridge 54 is inserted into the slit 44 of tension shaft 39. Thus, presser plate 53 is slidably sustained on shaft portion 41 with the presser plate 53 located between the spring seat 51 and the inner bottom surface of the cup-shaped presser 48. Numeral 55 denotes a second spring for the looper thread tension controller and is inserted into the screw hole 43. The bottom of the second spring 55 contacts the bridge 54 of the ring-shaped presser plate 53.

Numeral 56 denotes a tension knob and is screwed into the screw hole 43. Rotation of the tension knob 56 causes the second spring 55 to expand or contract and thereby the clamping force between looper thread discs 46 and 46*a* is adjusted as presser plate 53 and cup-shaped presser 48 move up and down. Numeral 57 denotes a tension release pin slidably inserted into the central hole of the tension shaft 39 and the top end surface of the tension release pin 57 contacts the bridge 54. The bottom end of the tension release pin 57 projects downward beyond the center bottom hole of the tension shaft 39. Numeral 58 denotes a slide plate which works as a controller for thread tensioning and provides four oblong holes 59, 59*a*, 59*b*, 59*c*.

Projections 60 are provided at the sides of the oblong holes 59, 59*a* and are contactable with projections 25, 25*a* projecting from the bottom of the sleeve 23. Projections 61 are provided at sides of the oblong holes 59*b*, 59*c* and are contactable with the lower end of tension release pin 57 provided at the looper thread tension controllers 38, 38*a*. The slide plate 58 is slidably located at the clearance 7 between the cover 5 and the thread guide plate 8. The oblong holes 59, 59*a* receive the shaft portion 18 of tension shaft 16 with some clearance therebetween. The oblong holes 59*b*, 59*c* receive the spacer screw 6*b* with some clearance therebetween. Thus, the slide plate 58 is sustained so as to move freely right or left.

Figure 5:
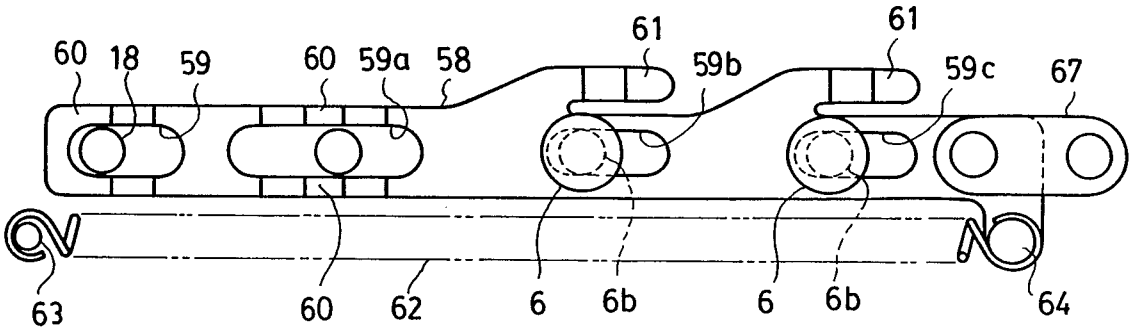
FIG. 5 is a plan view of a slide plate according to the invention.

Referring to FIG. 5, numeral 62 denotes a spring with one end connected to a pin 63 and the other end stretched to a stepped screw 64. Thus, the slide plate 58 is normally urged to move leftward.

Referring to FIG. 1, numeral 65 denotes a support plate with its lower portion fixed to body 2 and its upper portion bent like a channel and holding a solenoid 66 therein. Numeral 67 denotes a connecting link with its one end connected to the right end of slide plate 58 and its other end connected to the armature 68 of solenoid 66.

The solenoid 66 operates as follows: When a photo sensor provided on table 4 detects the leading edge of a workpiece, a workpiece detection signal is generated. After signal generation, when the sewing machine has made several rotations, the electric current to the solenoid 66 is cut and the slide plate 58 moves leftward.

When the photo sensor detects the trailing (rear) edge of the workpiece, the workpiece trailing edge detection signal is generated. After signal generation, when the sewing machine has made several rotations, electric current to the solenoid 66 is turned on and the solenoid is energized. Accordingly, the slide plate 58 moves rightward resisting the force of spring 62. Thus has been explained the construction of one embodiment according to the invention and operation of that embodiment will be explained hereinafter.

Referring to FIG. 1, from the needle thread supply source two threads are separately arranged to pass through thread holes 14, 14*a*, thread holes 9, 9*a*, to be clamped between the tension discs 27, 27*a*, and then to be introduced to each needle. Thus, each needle thread route is as follows: thread hole 14—thread hole 9—clamped between tension discs 27 and 27*a*—needle; and, thread hole 14*a*—thread hole 9*a*—clamped between tension discs 27 and 27*a*—needle.

From the looper thread supply source two looper threads are separately arranged to pass thread holes 14*b*, 14*c*, thread holes 11, 11*a*, to be clamped between the tension discs 46, 46*a*, and then to be introduced to each looper (not shown). Thus, each looper thread route is as follows: thread hole 14*b*—thread hole 11—clamped between tension discs 46 and 46*a*—looper; and, thread hole 14*c*—thread hole 11*a*—clamped between tension discs 46 and 46*a*—looper. Thereafter, the sewing machine may be started.

When the fabric workpiece to be overedged is inserted between the presser foot and the table for overedging, the workpiece sensor detects the edge of the workpiece and generates a signal. After generating the signal, when several stitches are finished, the solenoid 66 deenergizes. Thus, the slide plate 58 moves leftward by the spring 62 and the relative position of each part is as shown in FIGS. 1, 2, 3, and 4 and the general overedging process is conducted using two needle threads and two looper threads.

Figure 2:
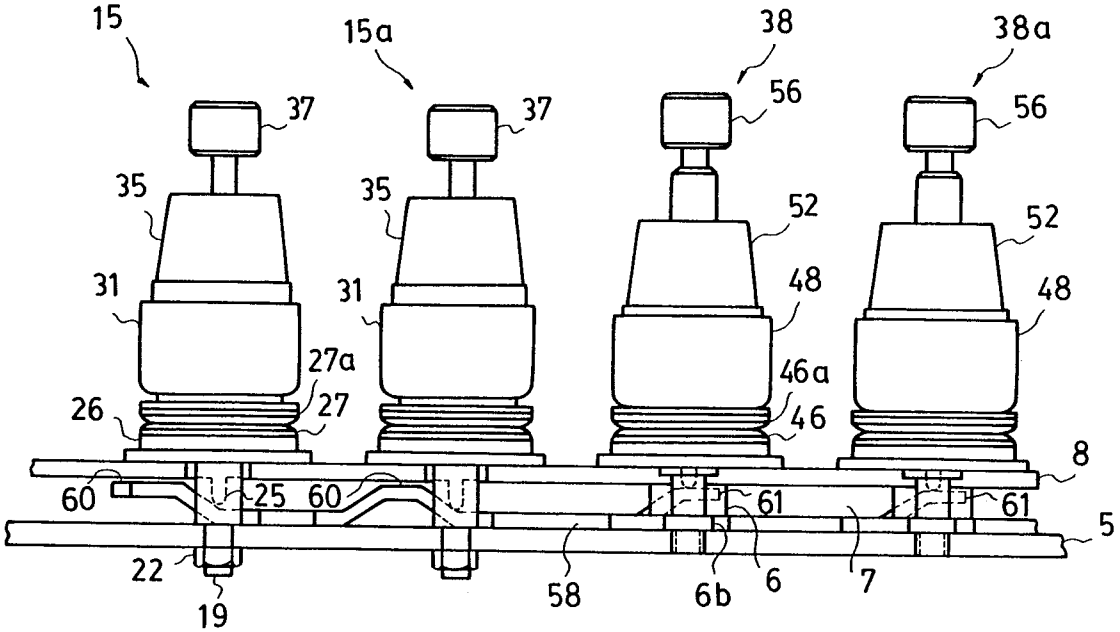
FIG. 2 is a partial sectional view along line II—II of FIG. 1.

In such an overedging process, as shown in FIGS. 2 and 3, the projection 60 provided on the slide plate 58 does not push up the projections 25, 25*a* provided at the lower portion of sleeve 23 and sleeve 23 descends. Accordingly, the ring-shaped presser plate 29 is pressed down by the first spring 33 and the second spring 36. Thereby, the needle thread clamped between the tension discs 27 and 27*a* receives a strong clamping force since the two springs 33 and 36 are pressing down on the ring-shaped plate 29.

Figure 4:
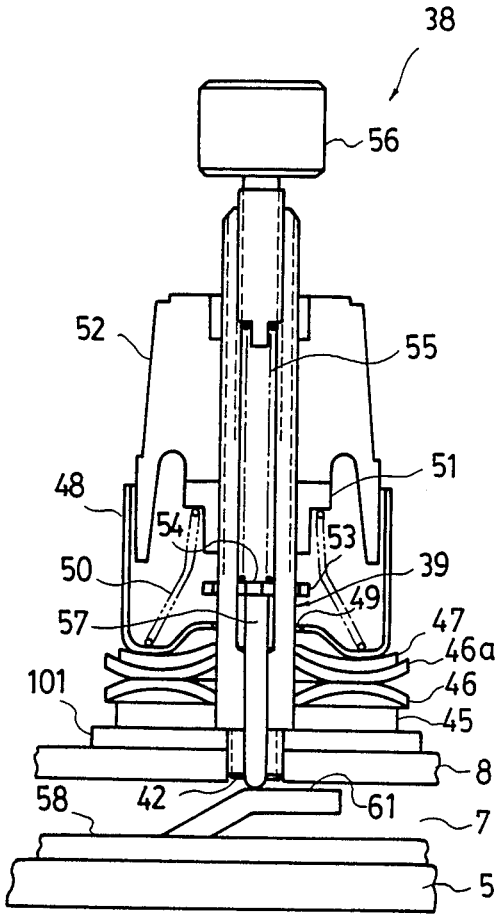
FIG. 4 is a partial longitudinal section view of a looper thread tension controller.

Referring to FIGS. 2 and 4, the projection 61 provided on the slide plate 58 pushes up the tension release pin 57 provided in the looper thread controllers 38, 38*a*. Accordingly, the ring-shaped presser plate 53 is pushed up and the downward pressing force of the cup-shaped presser 48 is released. Thereby, the looper thread clamped between the tension discs 46, 46*a* receives a weak clamping force since only the first spring 50 is pressing down.

Figure 7:
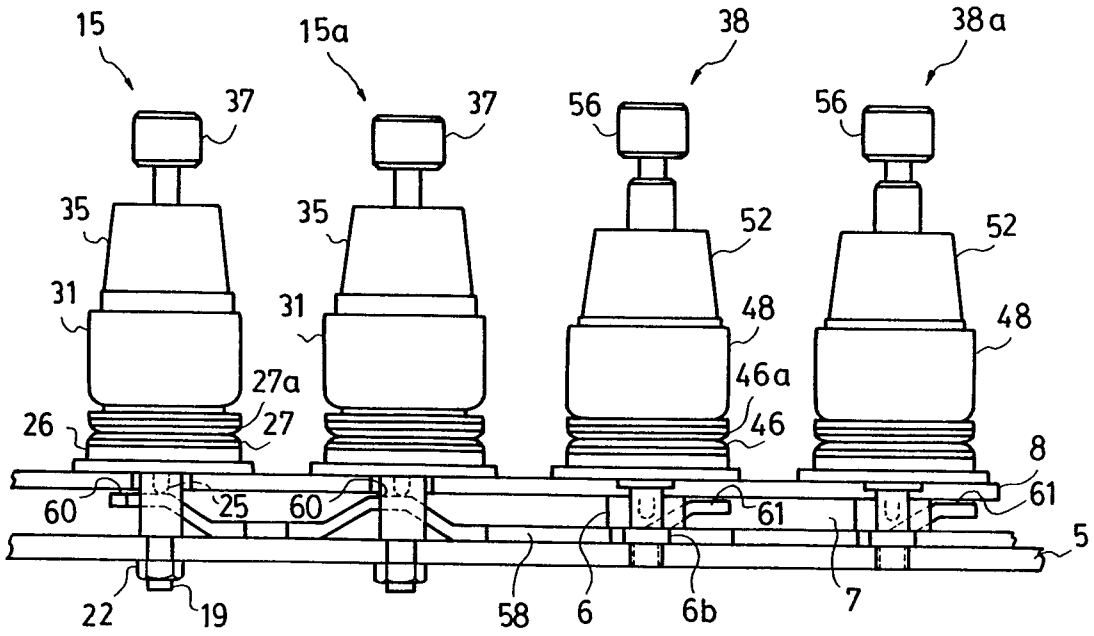
FIG. 7 is a partial sectional view of the thread tension controllers illustrating how each thread tension controller works during a thread chain forming process.
Figure 8:
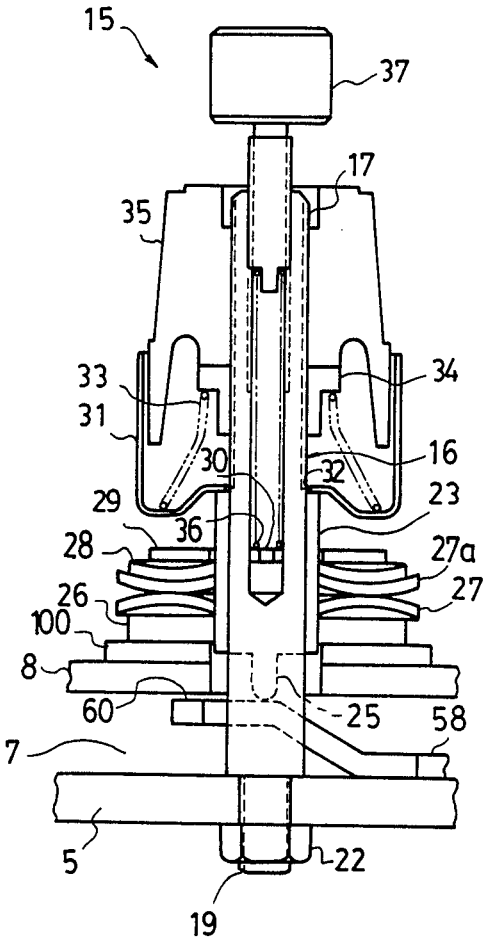
FIG. 8 is a partial longitudinal section view of a needle thread tension controller illustrating how the needle thread tension controller works during a thread chain forming process.
Figure 9:
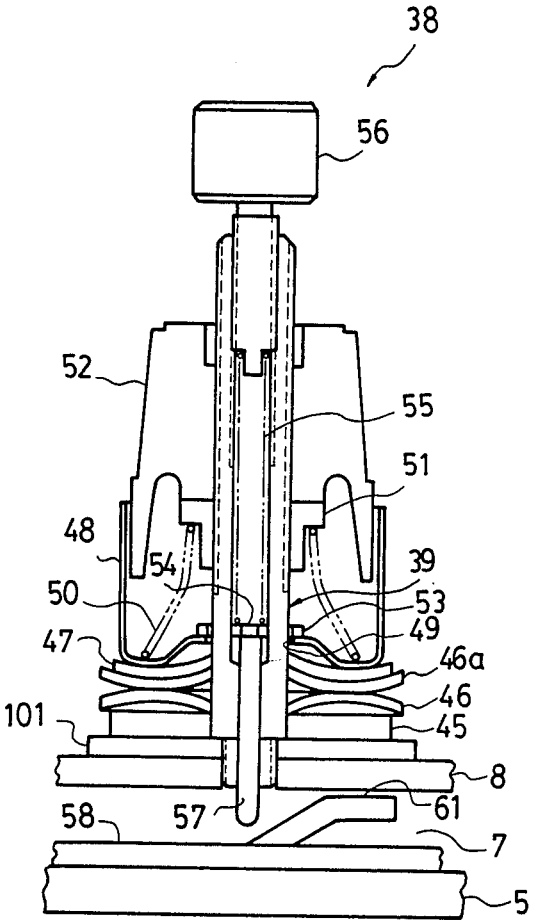
FIG. 9 is a partial longitudinal section view of a looper thread tension controller illustrating how the looper thread tension controller works during a thread chain forming process.

When the overedging process is finished, the trailing end of the workpiece is detected by the workpiece detector and the detector generates a signal. After generating a signal, when several stitches are finished, the solenoid 66 energizes. Thereby, the slide plate 58 moves rightward and relative position of each part is as shown in FIGS. 7, 8, and 9 and well adjusted thread chains are formed. During the chain forming process, as shown in FIGS. 7 and 8, the projection 60 on the slide plate 58 pushes up the projections 25, 25*a* provided at the lower portion of the sleeve 23. Accordingly, the upper end of sleeve 23 pushes up the cup-shaped presser 31 and the pressing-down force of the first spring 33 is released. Thus, the needle threads clamped between tension discs 27, 27*a* receive a weak clamping force since only the second spring 36 is pushing down the ring-shaped presser plate 29.

As for the looper thread tension controller 38, 38*a*, referring to FIGS. 7 and 9, the projection 61 on the slide plate 58 does not push up the tension release pin 57. Accordingly, the ring-shaped presser plate 53 descends and presses down the cup-shaped presser 48 with the second spring 55. Thereby, the looper thread clamped between the tension discs 46, 46*a* receives a strong clamping force since the two springs 50 and 55 are pressing down on the ring-shaped presser plate 53.

The above description with the accompanied drawings is related to the two-needle-thread, two-looper-thread sewing machines, but the description is also applicable to single-needle-thread, single-looper-thread sewing machines. Additionally, as for the sliding motion of the slide plate 58, although an automatic solenoid system which energizes or deenergizes in response to signals generated by a detector detecting the leading edge or trailing edge of the workpiece is utilized, manual operation of the slide plate 58 is also contemplated. Further, instead of slide plate 58, a rotary cam, solenoid device, or air cylinder device separately provided for each thread controller is also contemplated.

It is to be understood that the above-described embodiment of the invention is illustrative only and that modifications thereof may be made without departing from the scope and spirit of the invention.

What is claimed:

1. A thread tension control device for an overedging sewing machine comrising:

a needle thread tension controller having a first and second pressing means, the second pressing means provided at a shaft portion of the needle thread tension controller and pressing on at least one tension disc, and further having a sleeve arranged to move slidably up and down along the shaft such that the upward motion of the sleeve causes pressure from the first pressing means to release and the downward motion of the sleeve causes pressure of the first pressing means to act;

a looper thread tension controller having a third pressing means provided at a shaft portion of the looper thread tension controller and pressing on at least one tension disc, and further having a tension release pin arranged to move slidably up and down along the shaft such that the upward motion of the tension release pin causes pressure from the third pressing means to decrease and the downward motion of the sleeve causes pressure of the third pressing means to increase;

selection means moveable in relation to a sewing machine frame wherein one position of the selection means causes the sleeve of the needle thread tension controller to move downward and the tension release pin of the looper thread tension controller to move upward, and wherein another position of the selection means causes the sleeve of the needle thread tension controller to move upward and the tension release pin of the looper thread tension controller to move downward.

2. A thread tension control device as recited in claim 1, wherein said first and second pressing means comprise a plurality of springs.

3. A thread tension control device as recited in claim 1, wherein said selection means comprises a slide plate.

* * * * *